US009267676B2

(12) United States Patent
Berard

(10) Patent No.: US 9,267,676 B2
(45) Date of Patent: Feb. 23, 2016

(54) LUMINOUS NET FOR, INTER ALIA, SPORTS EQUIPMENT, AND SPORTS EQUIPMENT FOR BALL GAMES OR THE LIKE COMPRISING SAME

(75) Inventor: Herve Berard, Lansargues (FR)

(73) Assignee: CRAZY NETS, Lansargues (FR)

( * ) Notice: Subject to any disclaimer, the term of this patent is extended or adjusted under 35 U.S.C. 154(b) by 184 days.

(21) Appl. No.: 13/979,697

(22) PCT Filed: Jan. 12, 2012

(86) PCT No.: PCT/FR2012/050077

§ 371 (c)(1),
(2), (4) Date: Jul. 15, 2013

(87) PCT Pub. No.: WO2012/095610

PCT Pub. Date: Jul. 19, 2012

(65) Prior Publication Data

US 2013/0286648 A1 Oct. 31, 2013

(30) Foreign Application Priority Data

Jan. 14, 2011 (FR) ..... 11 50312

(51) Int. Cl.
*F21V 33/00* (2006.01)
*A63B 61/00* (2006.01)
(Continued)

(52) U.S. Cl.
CPC ..... *F21V 33/008* (2013.01); *A63B 61/003* (2013.01); *A63B 63/00* (2013.01); *A63B 71/06* (2013.01); *F21S 4/005* (2013.01); *F21S 4/007* (2013.01); *G09F 13/22* (2013.01);
(Continued)

(58) Field of Classification Search
CPC ..... F21S 4/002; F21S 4/005; A63B 63/008; A63B 63/004; F21V 33/008
USPC ..... 362/249.15, 249.14, 249.04
See application file for complete search history.

(56) References Cited

U.S. PATENT DOCUMENTS 2,468,773 A 5/1949 Musinski
4,263,640 A * 4/1981 Altman ..... 362/249.16
(Continued)

FOREIGN PATENT DOCUMENTS

DE 296 02 705 U1 6/1996
DE 297 11 772 U1 9/1997
(Continued)

OTHER PUBLICATIONS

French Search Report, dated Oct. 12, 2011, from corresponding French application.
(Continued)

*Primary Examiner* — Robert May
(74) *Attorney, Agent, or Firm* — Young & Thompson

(57) ABSTRACT

A luminous net, for example for sports equipment made of flexible elongate elements (10) that are contiguous at specific points, wherein at least some (10) of the flexible elements are luminous, and each includes: an elongate sheath (100) which is transparent to light and made of a synthetic material; a series of luminous members (102) distributed in the elongate sheath (100) in at least one row; and a flexible reinforcing cord (101) which is arranged in the sheath (100) and which extends across the entire length thereof, and which is capable of imparting tensile strength to the flexible element (10), the length of the cord in the sheath being equal to the length of the sheath.

20 Claims, 5 Drawing Sheets

Figure 1:
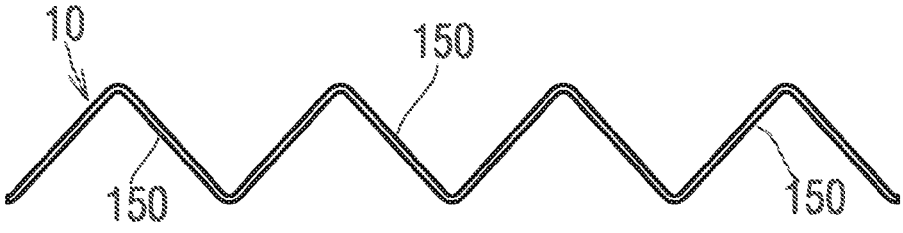

(51) Int. Cl.

| | |
|---|---|
| ***A63B 63/00*** | (2006.01) |
| ***F21S 4/00*** | (2006.01) |
| ***G09F 23/00*** | (2006.01) |
| ***G09F 13/22*** | (2006.01) |
| *A63B 61/02* | (2006.01) |
| *A63B 63/08* | (2006.01) |
| *A63B 71/06* | (2006.01) |
| *F21Y 101/02* | (2006.01) |

(52) U.S. Cl.

CPC ..... *G09F 23/00* (2013.01); *A63B 61/02* (2013.01); *A63B 63/004* (2013.01); *A63B 63/083* (2013.01); *A63B 2071/0694* (2013.01); *A63B 2207/02* (2013.01); *A63B 2243/0095* (2013.01); *F21Y 2101/02* (2013.01)

(56) References Cited

U.S. PATENT DOCUMENTS

| | | | | |
|---|---|---|---|---|
| 5,280,904 | A | 1/1994 | Rodriguez | |
| 5,424,925 | A | 6/1995 | Jenke et al. | |
| 5,632,550 | A | 5/1997 | Yeh | |
| 5,667,295 | A | 9/1997 | Tsui | |
| 5,800,046 | A | 9/1998 | Lin | |
| 5,882,742 | A | 3/1999 | Lin | |
| 6,566,824 | B2 * | 5/2003 | Panagotacos et al. | 315/291 |
| 6,604,841 | B2 * | 8/2003 | Liu | 362/235 |
| 6,969,185 | B1 | 11/2005 | Adair | |
| 2003/0021115 | A1 * | 1/2003 | Sloan et al. | 362/240 |
| 2003/0069096 | A1 | 4/2003 | Lin | |
| 2004/0043843 | A1 * | 3/2004 | Ryan | 473/476 |
| 2004/0208002 | A1 | 10/2004 | Wu | |
| 2006/0158883 | A1 | 7/2006 | Wu | |
| 2006/0197474 | A1 | 9/2006 | Olsen | |
| 2007/0072708 | A1 | 3/2007 | Reeb | |
| 2008/0088258 | A1 | 4/2008 | Ng | |
| 2008/0092800 | A1 | 4/2008 | Smith et al. | |
| 2008/0200061 | A1 | 8/2008 | Lee | |

FOREIGN PATENT DOCUMENTS

| | | | |
|---|---|---|---|
| EP | 0 069 665 | A1 | 1/1983 |
| EP | 0 805 304 | A2 | 11/1997 |
| ES | 2 060475 | A2 | 11/1994 |
| ES | 1 055 113 | U | 10/2003 |
| ES | 2 255419 | A1 | 6/2006 |
| FR | 2 908 051 | A3 | 5/2008 |
| GB | 2 187 392 | A | 9/1987 |
| WO | 2004/075996 | A2 | 9/2004 |
| WO | 2007006826 | A1 | 1/2007 |
| WO | 2009/125329 | A1 | 10/2009 |

OTHER PUBLICATIONS

Written Opinion dated Mar. 19, 2012, from corresponding PCT application.

International Search Report, dated Mar. 19, 2012, from corresponding PCT application.

* cited by examiner

LUMINOUS NET FOR, INTER ALIA, SPORTS EQUIPMENT, AND SPORTS EQUIPMENT FOR BALL GAMES OR THE LIKE COMPRISING SAME

TECHNICAL FIELD

This invention belongs to the field of equipment for outdoor or indoor sports fields and more particularly relates to a net and to a piece of sports equipment equipped with a net according to the invention, this piece of sports equipment being able to be not restrictively a goal, a basket, etc. This invention belongs also to the field of materials used for the display of luminous messages whether they are in the form of text and/or of icons.

PRIOR ART

Numerous ball, soccer ball or puck games use nets either to divide a playing area by a middle line, or to form, in combination with a carrying structure, a goal zone. According to the first illustrative case, the net is stretched vertically between two vertical end posts. In the second illustrative case, the net is fastened to a carrying structure and forms behind the latter a pocket for holding the ball or the puck.

The net can also be suspended from a circular carrying structure and can be arranged as a tube through which the ball or soccer ball passes.

To improve the attractiveness of the ball games, the prior art proposes to illuminate the sports equipment when a point is scored. In this way, certain pieces of equipment combine a series of electric bulbs of the LED type with the carrying structure of the net. Such an arrangement is described in particular in the patent application WO 2007006826. For other pieces of equipment, the luminous sources, in the form of a garland, are directly combined with the net. Such an arrangement is described in particular in U.S. Pat. No. 5,280,904.

The use of nets in an informative design is also known. Such nets are known in particular from U.S. Pat. No. 6,969,185.

DISCLOSURE OF THE INVENTION

The solutions specified by the state of the art prove costly since they consist in equipping an existing material with a luminous unit.

The object of this invention is in particular to solve this problem.

For this purpose, this invention relates mainly to a luminous net for sports equipment or the like, made from flexible elongate elements that are occasionally joined. This net is characterized essentially in that at least some of the flexible elements are luminous and each one consists of a sheath of a material transparent to light, a series of luminous elements distributed in the sheath in at least one line, and a flexible reinforcing cable placed in the sheath and extending over the entire length of the latter, able to impart a tensile strength to the flexible elongate element, the length of said cable in the sheath being equal to the length of said sheath.

Because of such arrangements, the luminous flexible elongate elements are an integral part of the net that reduces the cost of the latter. The reinforcing cable that each luminous elongate element has is likely to impart to the latter a resistance to the pulling force resulting from the impact of a soccer ball, a ball or a player on the net and thus to protect against any damage, the luminous elements placed in the transparent sheath, the latter also ensuring the protection of the luminous elements against impacts and bad weather.

The luminous elements can be made of phosphorescent pellets or the like but preferably, to control the luminous effect produced and to trigger the luminous emission during particular phases of the game, such as scoring of points and the like, the luminous elements are of the type of those able to emit a light signal when an electric current passes through them. These luminous elements are supplied with electric power by a power-supply bus in the form of several electrical conductors installed in the sheath and connected to an electric power source that is outside or inside the sheath. Additionally, the luminous elements are also connected to a control bus that is inside the sheath.

Advantageously, to reduce the electric power consumption, each luminous element, according to another aspect of the invention, is made of an electroluminescent diode. This type of component further exhibits the advantage of better resistance to impact than an electric bulb and of being of a reduced cost.

To ensure better control of the luminous effect, the electroluminescent diodes are addressable and are connected to a control bus in the sheath and connected by control means. In this way, each diode can be supplied with electric power independently of the others according to a relationship of pre-established order for the purpose of producing a particular luminous effect.

The control bus, according to another arrangement of the invention, will be controlled remotely via a wire connection or a radio link by a command and control unit that incorporates suitable software. Thanks to this unit, it will be possible to form luminous images on the net or lettering such as, not restrictively, messages having an informative or promotional nature, these messages being able to be stationary over the time of the display or else scrolling.

According to another arrangement of the invention, the luminous elements, the reinforcing cable, and the control and power-supply buses are embedded in the material of the sheath, said sheath being formed by extrusion around these elements. By the nature of this arrangement, the different components are held on all sides by the sheath and are fixed in position in relation to one another.

According to another arrangement of the invention, each diode is mounted on a flat support that incorporates electronics for power supply, for control and for management that constitute a means for controlling said diode.

According to another arrangement of the invention, the different flat supports are evenly spaced from one another; the different control and management means that the different flat supports comprise are successively joined electrically by electric control conductors and by electric conductors for electric power supply; the different flat supports are fastened on the cable, and the control and management wires and the power-supply wires, between two successive flat supports, each form a curved line in the sheath. The curved line that each electric wire forms constitutes a reserve of length to prevent them from breaking loose under a pull exerted on the sheath. Thus, only the cable and the sheath absorb the pulling forces.

According to another arrangement of the invention, the flat support is formed by a multilayer printed circuit. Such an arrangement is able to reduce the dimensions of this flat support for a better incorporation into the sheath. Moreover, the multilayer technology makes it possible to optimize the distribution of electric power to the different electric elements associated with the flat support and without risk of damage by the Joule effect of the tracks concerned of the printed circuit.

According to another arrangement of the invention, the sheath at each diode is obscured so as to obtain a diffusing effect of the light.

According to still another arrangement of the invention, the electronics for power supply, for control and for management that each flat support has, incorporates an active power supply able to charge by chopping a power-supply capacitor of the diode and to measure the voltage at its input terminals to determine the chopping frequency.

Advantageously, according to another arrangement of the invention, luminous elongate elements are fastened to one another at their junction by attachment means. These attachment means have a function of fixing the elongate elements in position in relation to one another and of shaping the mesh that the net exhibits.

According to another arrangement of the invention, each luminous elongate element of the net forms waves. This arrangement allows a coplanar arrangement of the luminous elongate elements while ensuring the formation of the meshes.

This invention also relates to a piece of sports equipment comprising a carrying structure and a net consistent with the invention fastened to this carrying structure.

SUMMARY DESCRIPTION OF THE FIGURES AND DRAWINGS

Figure 2:
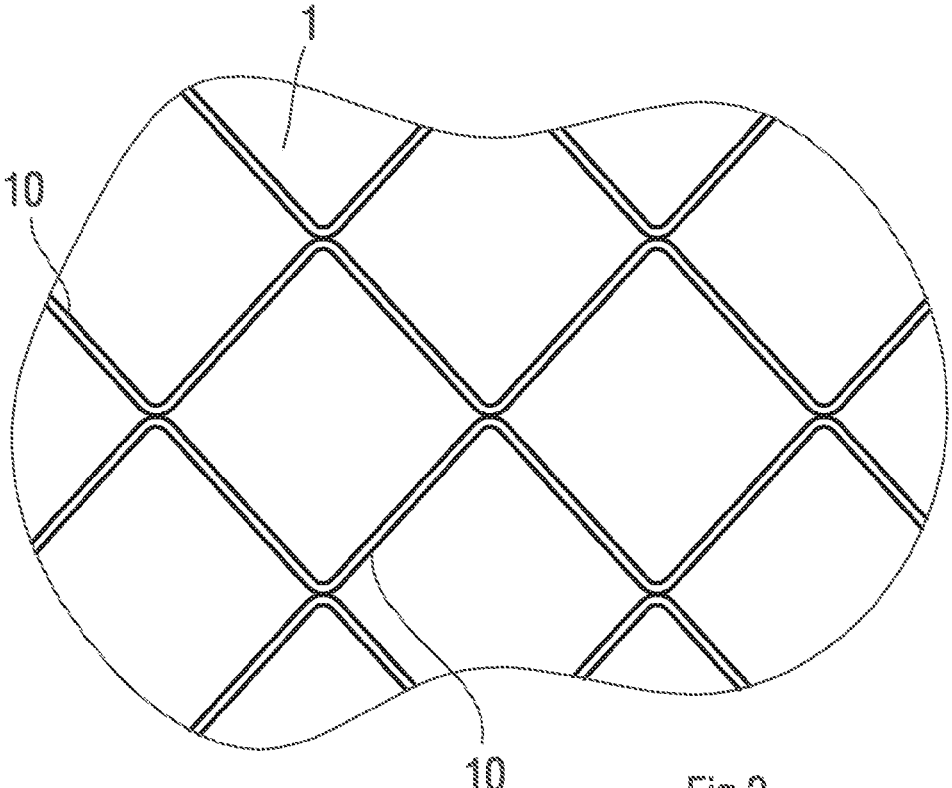
Figure 3:
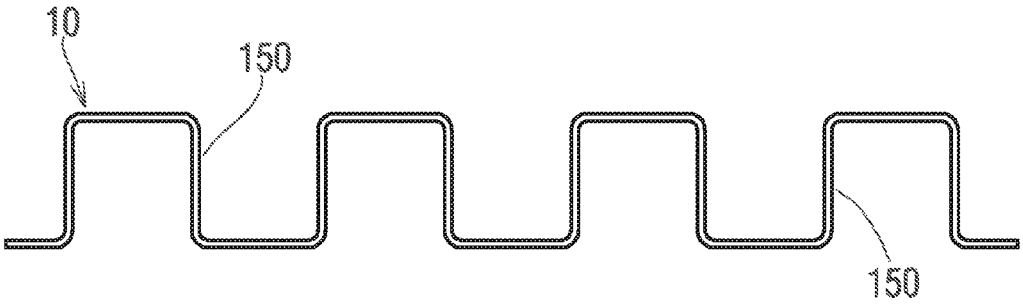
Figure 4:
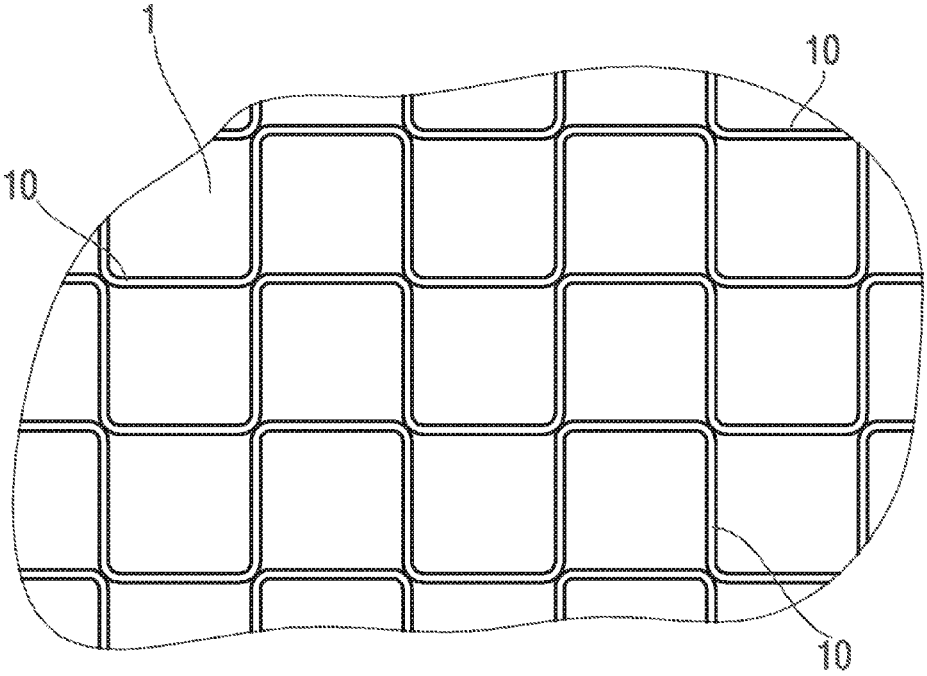
Figure 5:
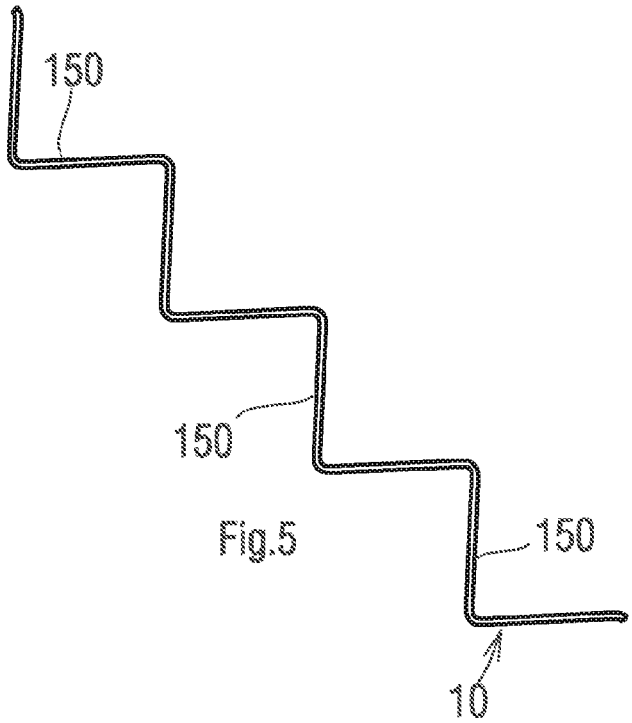
Figure 6:
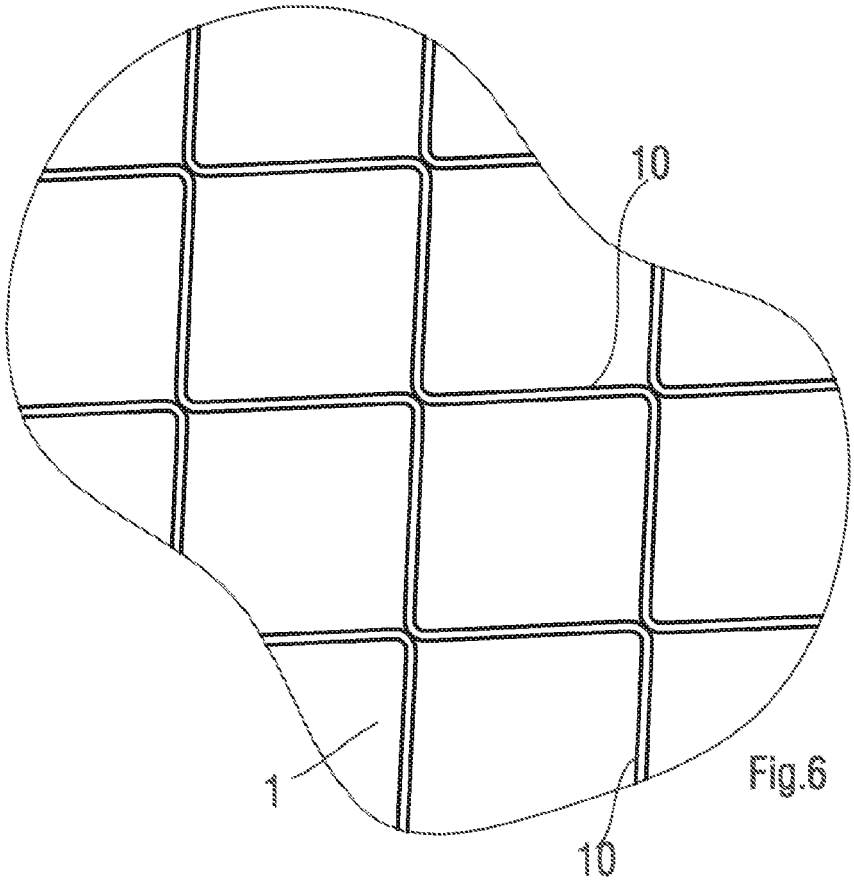
Figure 7:
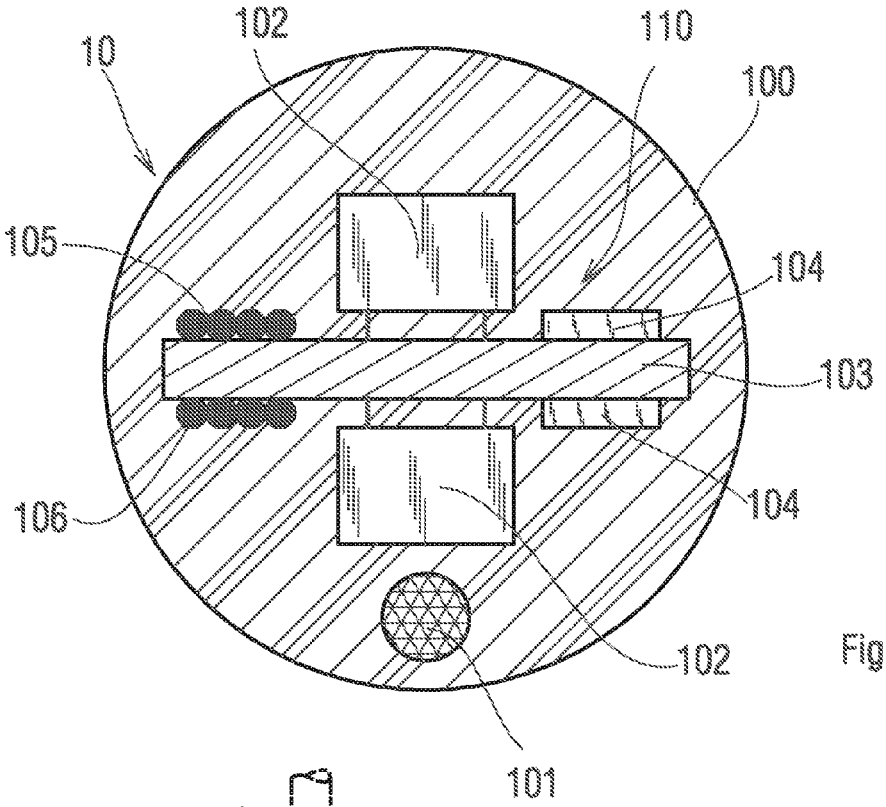
Figure 8:
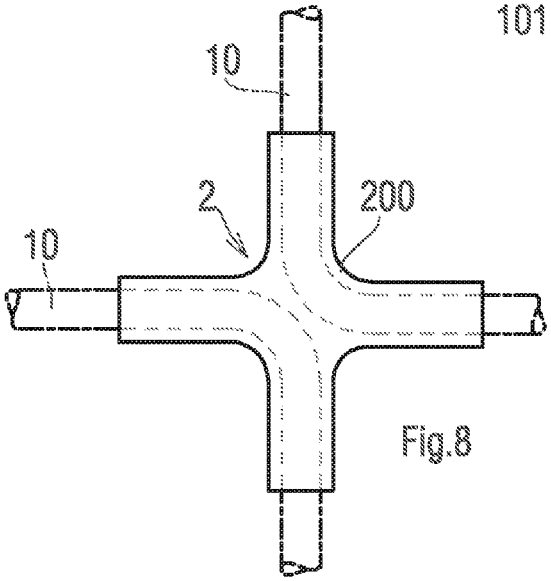
Figure 9:
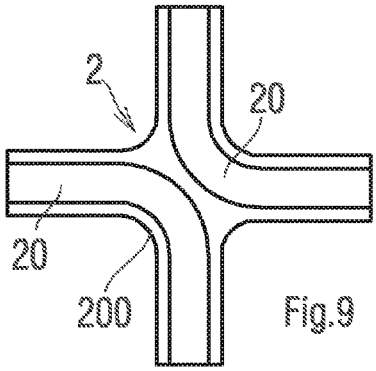
Figure 10:
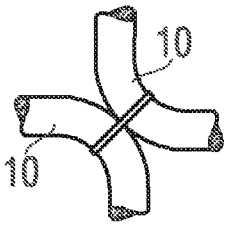
Figure 11:
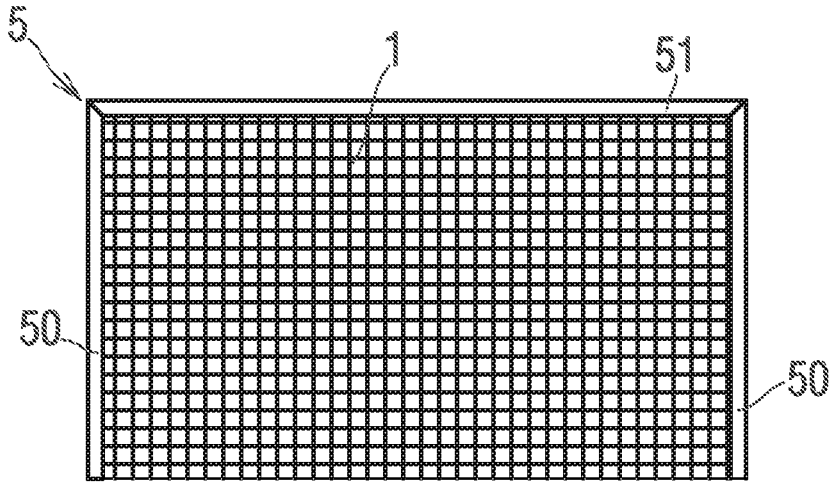
Figure 12:
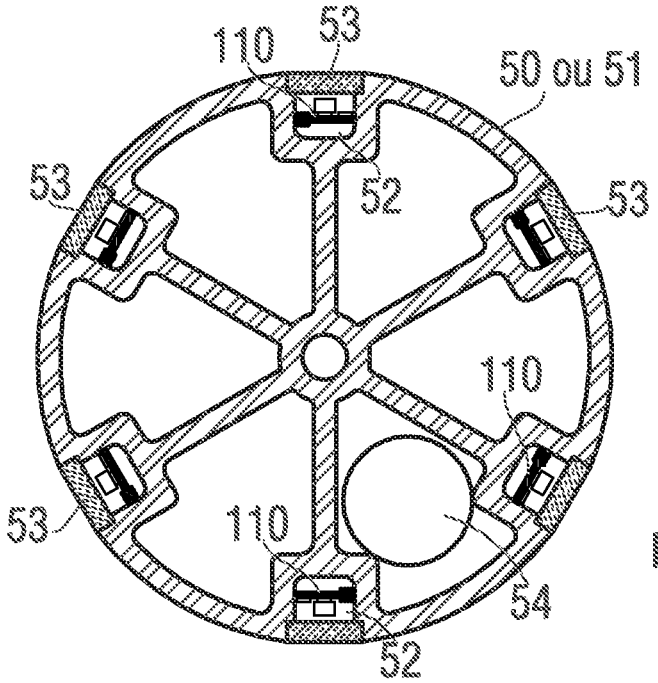

Other advantages, objects and characteristics of the invention will come out from reading the description of a preferred embodiment given by way of nonlimiting example while referring to the accompanying drawings in which:

FIG. 1 is a front view of a luminous element according to a first embodiment, FIG. 2 is a front view of a net made from a luminous element according to FIG. 1, FIG. 3 is a front view of a luminous element according to a second embodiment, FIG. 4 is a view of a net made from a luminous element according to FIG. 3, FIG. 5 is a front view of a luminous element according to a third embodiment, FIG. 6 is a view of a net made from a luminous element according to FIG. 5, FIG. 7 is a cutaway view along a straight cross-section of a constitutive luminous elongate element of the net, FIG. 8 is a plan view of a cross-brace, FIG. 9 is a view of one of the two half-shells that make up the cross-brace according to FIG. 8, FIG. 10 is a view of an attachment means of the clasp type, FIG. 11 is a front view of a piece of sports equipment of the goal type comprising a net according to the invention, FIG. 12 is a straight cross-section of a post or of a cross-piece of the carrying structure that the goal comprises according to FIG. 10.

BEST WAY TO IMPLEMENT THE INVENTION

In FIGS. 2, 4 and 6, a net 1 according to the invention is shown. This net 1 consists of assembling several flexible elongate elements 10, occasionally joined, some or all of which are luminous. Each elongate element 10 can be rectilinear or else forms regular waves 150.

In FIGS. 1 and 3 and 5, three embodiments of a flexible, wavy, luminous elongate element are shown, this element exhibiting a series of hollows and peaks. The waves are formed by folding the luminous elongate element. In FIG. 1, it can be noted that the waves that form each luminous elongate element are triangular while in FIG. 3, the waves that each luminous elongate element 10 exhibits are square. In FIG. 5, the waves form right angles.

As can be seen in FIGS. 2, 4 and 6, the luminous elongate elements 10 are parallel to one another and coplanar and form equidistant rows in occasional contacts with one another. For a net made from luminous elongate elements 10 exhibiting triangular waves according to FIG. 1, each element will be offset longitudinally in relation to each contiguous element. Thus, the hollows that each luminous elongate element 10 exhibits will be opposite the hollows that the or each contiguous luminous elongate element exhibits. This configuration is able to form the meshes of the net, these meshes then exhibiting a polygonal outline that is square or rhombus-shaped. For a net made from elongate elements 10 that exhibit square or rectangular waves (FIG. 4), no longitudinal offsetting will be made between the luminous elongate elements 10. According to this arrangement, each mesh formed corresponds to one of the hollows determined by the waves. With regard to the net that is the object of FIG. 6, each luminous elongate element 10 adopts a step-like arrangement.

Installed at each contact point between the luminous elongate elements 10 is an attachment means, described further on, that ensures a function of shaping the meshes of the net.

In the previously described embodiment, the luminous elongate elements 10 are coplanar and wavy. According to another embodiment, the elongate elements 10 are substantially rectilinear and are arranged in rows and columns. The rows and the columns will be oblique or perpendicular in relation to one another. According to a first variant, the rows and columns are interlaced whereas according to a second variant embodiment, the rows are placed along a first plane and the columns along a second plane. The columns and the rows are occasionally joined, and an attachment means will be placed at each contact point between the rows and columns.

FIG. 5 shows a luminous elongate element 10 in a straight cross-section. This elongate element 10 consists of a sheath 100 of synthetic material that is flexible, transparent to light, and able to resist aging due to the effects of bad weather and sunlight. In the sheath 100, this element is provided with a reinforcing cable 101 able to withstand elastic expansion and thus to impart a tensile strength to the sheath. This cable 101 is flexible and greatly minimizes the capability of the sheath to stretch out under a pulling force. This cable will advantageously consist of synthetic material, for example of the type of that known under the trade name of "KEVLAR." The reinforcing cable 101 stretches out in the sheath 100 in the direction of the length of the latter. The length of the cable in the sheath is equal to the length of the sheath. In this way, the cable forms no reserve of length in the sheath.

Sheath 100 also contains luminous elements 102 consisting of electroluminescent diodes, preferably addressable, connected to an electric power-supply bus 105 as well as to a control bus 106. The electric power-supply bus is connected to an electric power source, preferably outside of the sheath 100. The control bus 106 is connected to a control unit known in the art.

Each diode 102 is advantageously mounted on a flat support 103 made of a multilayer printed circuit incorporating electronics 104 for power supply, control and management, constituting a control means, provided to control the diode, i.e., particularly to enable or interrupt the passage of current in the latter and to control it in color.

This flat support 103, the diode 102 and the control electronics 104 thus form an addressable luminous module 110, connected to the adjacent luminous modules by the electric power-supply bus 105 and by the control bus 106.

Preferably, the power-supply electronics is of the chopping type and is associated electrically with a capacitor for supplying the diode. This power-supply electronics is able to control the chopping frequency as a function of the input voltage at its terminals. In this way, the power losses are thus taken into account.

Advantageously, so as to ensure optimal illumination, each support 103 will receive two opposite diodes operating in concert.

The luminous modules 110 are placed at a constant distance from one another and are each fastened by the flat support 103 to the cable 101. Preferably, the flat support 103 of each module will be fastened to the cable by a glue point or by any other means. Stretched out between two adjacent modules are the electric wires 105 of the power-supply bus and the electric wires 106 of the control bus. To prevent their breaking, the latter advance in a curved line. Thus, the cable in the sheath is stretched whereas the wires of the control and power-supply bus are not.

According to a preferred embodiment, the reinforcing cable, the luminous modules 110, the power-supply bus 105 and the control bus 106 are embedded in the material that makes up the sheath 100, this sheath being formed by extrusion around these elements. Thus, the material of the sheath is intimately in contact both with the cable 101 as well as with the various electric components that ensure the holding of the latter in the sheath in a fixed position. To strengthen the adherence of the cable in the sheath, the latter will be able to be slightly twisted or else to comprise knots.

Still to ensure optimal illumination, the sheath, at each diode, will be able to be slightly obscured so as to create a circular diffusion effect of the light. The obscuring of the sheath will be able to be obtained by injection of suitable material during the extrusion or else by any other suitable means.

Advantageously, each luminous elongate element 10 that makes up the net 1 is connected to a distribution harness that is common to the various elements 10, this harness exhibiting a power-supply bus and a control bus to which are connected respectively, by suitable connectors, the power-supply bus 105 and the control bus 106 of each luminous elongate element 10.

The possibility of addressing the electroluminescent diodes and more precisely the corresponding modules makes it possible to supply them individually and to identify their respective position in the net. Thus, a diode position will correspond to each address, according to, for example, a system of Cartesian coordinates, the diodes being placed along the horizontal lines and the vertical columns.

The control bus is controlled remotely via a wire connection or a radio link by a command and control unit that incorporates suitable software. By the nature of these arrangements, it becomes possible to form with the net a display screen on which messages will be displayed that are stationary or scrolling in the form of text and/or images that are static or animated.

In FIGS. 8 and 9, an embodiment of an attachment means is shown. According to this embodiment, this attachment means is depicted in the shape of a cross-brace 2 of material that is transparent to light.

As can be observed in these figures, this cross-brace 2 provides the mechanical connection between two meshes due to juxtaposition along the same diagonal, and forms two tubular sleeves 20 that are bent, opposite, and provided to receive respectively the two adjacent flexible elongate elements 10. Each bent sleeve forms one of the angles of the mesh.

Preferably, so as to facilitate the mounting, each cross-brace 2 consists of two half-shells 200 that can be joined to one another along a median mating surface.

According to another embodiment, each attachment means consists of a clasp (FIG. 10), or a flexible knot-forming connection around the two luminous elongate elements. In turn, the luminous elongate elements are connected to one another by glue points as can be seen in FIGS. 2, 4, and 6.

In FIG. 11, a piece of sports equipment is shown that comprises a net 1 according to the invention and that forms a goal for a ball or soccer game. This goal comprises a rigid carrying structure 5 of quadrangular shape that forms two vertical posts 50 and a horizontal upper cross-piece 51.

Fastened to this structure 5, by its edge, is a net 1 according to the invention that forms behind said structure a pocket for retaining the ball or soccer ball. This carrying structure is equipped with longitudinal housings 52 in which luminous elongate modules 110 are placed.

Advantageously, as can be seen in FIG. 12, the posts and/or the cross-piece of the structure is/are grooved and receive(s), in the channels 52 formed, luminous elongate elements 110 such as those previously described. These elongate elements 10 are always associated with an electric power supply bus and with a control bus. The channels 52 formed will be able to be covered with a protective covering 53 of material that is transparent to light.

Preferably, at least one of the elements of the carrying structure (post 50 or crosspiece 51) will be equipped with the above-mentioned distribution harness.

Advantageously, the posts 50 of this carrying structure 5 will incorporate, into a suitable housing, a set of electric batteries 54 that constitute the electric power source of the various modules 110.

The sports equipment as described is not limited to a goal; on the contrary, this sports equipment can be a basket for use in the game of basketball. It can also form a dividing barrier of a playing area for use in, for example, tennis, volleyball, etc. In this illustrative case, the carrying structure of the sports equipment will be formed by two vertical posts separated from one another and a cable stretched between these two posts, the net 1 then being suspended from this cable.

Likewise, the use of the net is not limited to only pieces of sports equipment; on the contrary, the net according to the invention can be used as a display element for advertising messages and the like.

Of course, this invention can accommodate any arrangements and variants from the field of technical equivalents without thereby exceeding the scope of this patent as defined by the claims below.

The invention claimed is:

1. Luminous net, comprising:

plural elongate flexible elements (10) joined one to another, wherein each flexible element (10) comprises i) an elongate sheath (100) of synthetic material that is transparent to light, the sheath (100) comprising a plurality of straight sections connected at angular corner portions, the straight sections and corner portions together defining an overall length of the sheath, the straight sections and corner portions having an outermost exterior surface, ii) a series of luminous elements (102) distributed within the sheath (100), and iii) a flexible reinforcing cable (101) located within the sheath (100) and extending over the overall length of the sheath (100), the cable (101) imparting a tensile strength to the flexible element (10), an overall length of said cable being equal to the overall length of said sheath, wherein an exterior surface portion of each of a plurality of the corner portions of each sheath are joined to a corresponding exterior surface portion of each of a plurality of the corner portions of an adjacent one of the sheaths.

2. Net according to claim 1, wherein the luminous elements (102) are able to emit light when an electric current passes through them and wherein said elements (102) are supplied with electric power by conductors (105) installed in the sheath (100) and connected to an electric power source via a control means (104).

3. Net according to claim 2, wherein the luminous elements (102) are electroluminescent diodes.

4. Net according to claim 3, wherein the electroluminescent diodes (102) are addressable and wherein the sheath (100) receives, in addition, a control bus connected electrically to said diodes (102).

5. Net according to claim 4, wherein each diode (102) is mounted on a flat support (103) that incorporates electronics (104) for power supply, for control and for management that constitute a means for controlling said diode (102).

6. Net according to claim 5, wherein the flat supports (103) are evenly spaced apart from one another, wherein the electronics for power supply, for control and for management that the flat supports (103) are successively joined electrically by electric control conductors and by electric conductors for electric power supply, wherein the flat supports (103) are fastened on the reinforcing cable (101), and wherein the control and management wires and the power-supply wires, between two successive flat supports (103), each form a curved line in the sheath (100).

7. Net according to claim 6, wherein the flat supports (103) are formed by multilayer printed circuits.

8. Net according to claim 5, wherein each support (103) receives two opposite diodes (102) operating in concert.

9. Net according to claim 1, wherein the reinforcing cable (101) and the luminous elements (102) are embedded in the material in the sheath (100), the latter being flexible and being formed by extrusion around these elements.

10. Net according to claim 1, wherein the sheath (100) of each flexible element (10), at each diode (102), is obscured so as to obtain a diffusing effect of the light.

11. Net according to claim 1, further comprising an attachment means at the corner portions of each sheath, wherein the flexible elements (10) are joined to one another at the corner portions by the attachment means.

12. Net according to claim 11, wherein each attachment means consists of a cross-brace (2) made of two half-shells (200) joined to one another along a median mating surface.

13. Net according to claim 12, wherein each cross-brace (2) forms two opposite bent sleeves (20) that can each receive one said flexible element (10).

14. Net according to claim 11, wherein the attachment means consist of clasps.

15. Net according to claim 11, wherein the attachment means consist of glue points.

16. Net according to claim 1, wherein each flexible element (10) forms waves (150), and the corner portions form right angles.

17. Net according to claim 1, wherein each flexible element (10) is connected to a distribution harness that is common to the all the flexible elements (10), the harness exhibiting a power-supply bus and a control bus to which are connected respectively, by suitable connectors, the power-supply bus (105) and the control bus (106) of each flexible element (10).

18. Sports equipment for a playing area, comprising a carrying structure (5) and a net (1) according to claim 1, fastened to said carrying structure.

19. Sports equipment according to claim 18, wherein the carrying structure (5) comprises longitudinal housings (52) in which luminous elongate modules (10) are placed.

20. A luminous net for sporting equipment, comprising:

plural elongate flexible elements (10) fastened one to another, each said flexible element (10) comprising i) a transparent elongate sheath (100), ii) a series of spaced-apart luminous elements (102) located within the sheath (100) and distributed along an overall length of the sheath (100), and iii) a flexible reinforcing cable (101) within the sheath (100), the cable (101) extending over the overall length of the sheath (100), the cable (101) imparting a tensile strength to the flexible element (10), the sheath (100) comprising a plurality of straight sections connected at angular corner portions that include a first corner portion at a first end of each sheath, a second corner portion at an opposite, second end of each sheath, and plural corner portions located between said first and second corner portions of each sheath; and attachment means that fasten i) the first corner portion, the second corner portion, and the plural corner portions located between said first and second corner portions of each sheath, to ii) the first corner portion, the second corner portion, and the plural corner portions located between said first and second corner portions of an adjacent one of the sheaths.

* * * * *